United States Patent [19]

Bachmann et al.

[11] Patent Number: 4,558,618

[45] Date of Patent: Dec. 17, 1985

[54] ADJUSTABLE FENCE FOR A SAW TABLE OR THE LIKE

[75] Inventors: Rainer Bachmann, Hohenstein; Hartmut van Hauten, Wiesbaden, both of Fed. Rep. of Germany

[73] Assignee: Black & Decker Inc., Newark, Del.

[21] Appl. No.: 623,776

[22] Filed: Jun. 22, 1984

[30] Foreign Application Priority Data

Jun. 25, 1983 [DE] Fed. Rep. of Germany ... 8318518[U]

[51] Int. Cl.[4] ..... B26D 7/06

[52] U.S. Cl. ..... 83/438; 83/477.2; 269/303; 269/315

[58] Field of Search ..... 83/438, 446, 467, 698–700, 83/471, 471.1, 471.2, 471.3, 477.2; 144/253 R; 269/36, 303–305, 315, 318

[56] References Cited

U.S. PATENT DOCUMENTS

| | | | |
|---|---|---|---|
| 1,938,548 | 12/1933 | Tautz | 83/438 |
| 2,630,845 | 3/1953 | Eschenburg | 83/438 |
| 2,808,084 | 10/1957 | Eschenburg | 83/438 |
| 3,090,615 | 5/1963 | May | 83/446 |
| 4,481,846 | 11/1984 | Goodell | 83/438 |

FOREIGN PATENT DOCUMENTS

| | | |
|---|---|---|
| 7239236 | 4/1973 | Fed. Rep. of Germany . |
| 2904685 | 8/1980 | Fed. Rep. of Germany . |

*Primary Examiner*—James M. Meister
*Assistant Examiner*—John L. Knoble
*Attorney, Agent, or Firm*—Ronald B. Sherer; Harold Weinstein; Edward D. Murphy

[57] ABSTRACT

An adjustable fence for a saw table, or the like, comprises a main fence member defining a longitudinal direction and having a first clamping portion at one end. An auxiliary fence member is pivoted to the main fence member about an axis at right angles to that longitudinal direction and extends from the other end of the main fence member. The auxiliary fence member has a second clamping portion spaced longitudinally from the first clamping portion. A screw engages between the main and auxiliary fence members and is actuatable by one hand of an operator to adjustably pivot the auxiliary fence member relative to the main fence member to clamp the first and second clamping portions against opposite sides of the table. An extension fence may be slidably mounted over the main fence member and be adjustably secured in position by the same screw.

18 Claims, 6 Drawing Figures

ADJUSTABLE FENCE FOR A SAW TABLE OR THE LIKE

FIELD OF THE INVENTION

This invention relates to adjustable fences for saw tables or the like, particularly such fences which are movable sideways across the saw table or the like and are releasably clampable in a selected position.

BACKGROUND OF THE INVENTION

Such a fence is disclosed in German Offenlegungsschrift No. 2,904,685 in which clamping is effected by means of screws provided in two clamping regions of the fence. Both these screws are tightened to ensure that the fence does not shift under the load exerted against it by the workpiece being guided thereby while the workpiece is being machined. The disadvantage of this fence is that the user has to fasten it at both ends in order to position and fix it, that is to say, for adjustment purposes, the user first has to loosen two screws and then has to tighten both of them again.

Furthermore, there is also disclosed in German Utility Model No. 7,239,236 a fence which is fastened only at one end by clamping. However, with this fence there is the risk that the free end of the fence may be pivoted or deformed by the load exerted on it by the workpiece.

SUMMARY OF THE INVENTION

The object of the present invention is to provide a fence for a saw table or the like which can be secured at both of its ends in a simple way be means of clamping.

A feature by which this object is achieved is by providing the fence with a pivotal end and a single operating device for effecting pivoting of that end to clamp both ends of the fence against the saw table or the like. This provides the advantage that only one operating device, e.g. a screw, has to be actuated to firmly secure both ends of the fence to the saw table or the like.

Another optional feature of the invention is the provision of an extension fence slidable over and along the main fence and also securable in position by said operating device. This provides the advantage that the position of the main fence relative to the saw table and the position of the extension fence relative to the main fence can both be simultaneously fixed by a single operation of said operating device.

Accordingly, therefore, the present invention provides an adjustable fence for a saw table, or the like, comprising an elongate main fence member defining a longitudinal direction and having a first clamping portion at one end; an auxiliary fence member pivoted to said main fence member about a pivotal axis at right angles to said longitudinal direction, said auxiliary fence member extending from the other end of said main fence member and having a second clamping portion spaced from said first clamping portion in said longitudinal direction; and means, connected between said main and auxiliary fence members and actuatable by one hand of an operator, for adjustably pivoting said auxiliary fence member relative to said main fence member to shorten the distance between said first and second clamping portions, whereby said first and second clamping portions can be clamped against opposite sides of said table with said main fence member extending over the surface of said table.

Preferably, the main fence member is hollow and the auxiliary fence member extends inside the main fence member.

The adjustably pivoting means preferably comprises a headed screw threadedly engaging the auxiliary fence member and extending at right angles to the pivotal axis with the head of the screw being supported by and bearing against the outside of the main fence member.

Both fence members may be provided with inwardly directed foot portions spaced below the main fence member and forming the first and second clamping members. These foot portions preferably engage in grooves along opposite sides of the table and below the surface thereof.

An extension fence may be slidably mounted on the main fence and be displaceable thereon in the longitudinal direction, the position of the extension fence relative to the main fence being adjustably secured by the adjustably pivoting means. This makes it possible to guide workpieces which exceed the dimensions of the saw table and also to prevent a cut-to-length workpiece part from becoming jammed between the saw blade and fence.

Other objects, features and advantages of the present invention will become more fully apparent from the following detailed description of the preferred embodiment, the appended claims and the accompanying drawings.

DETAILED DESCRIPTION OF THE PREFERRED EMBODIMENT

Figure 1:
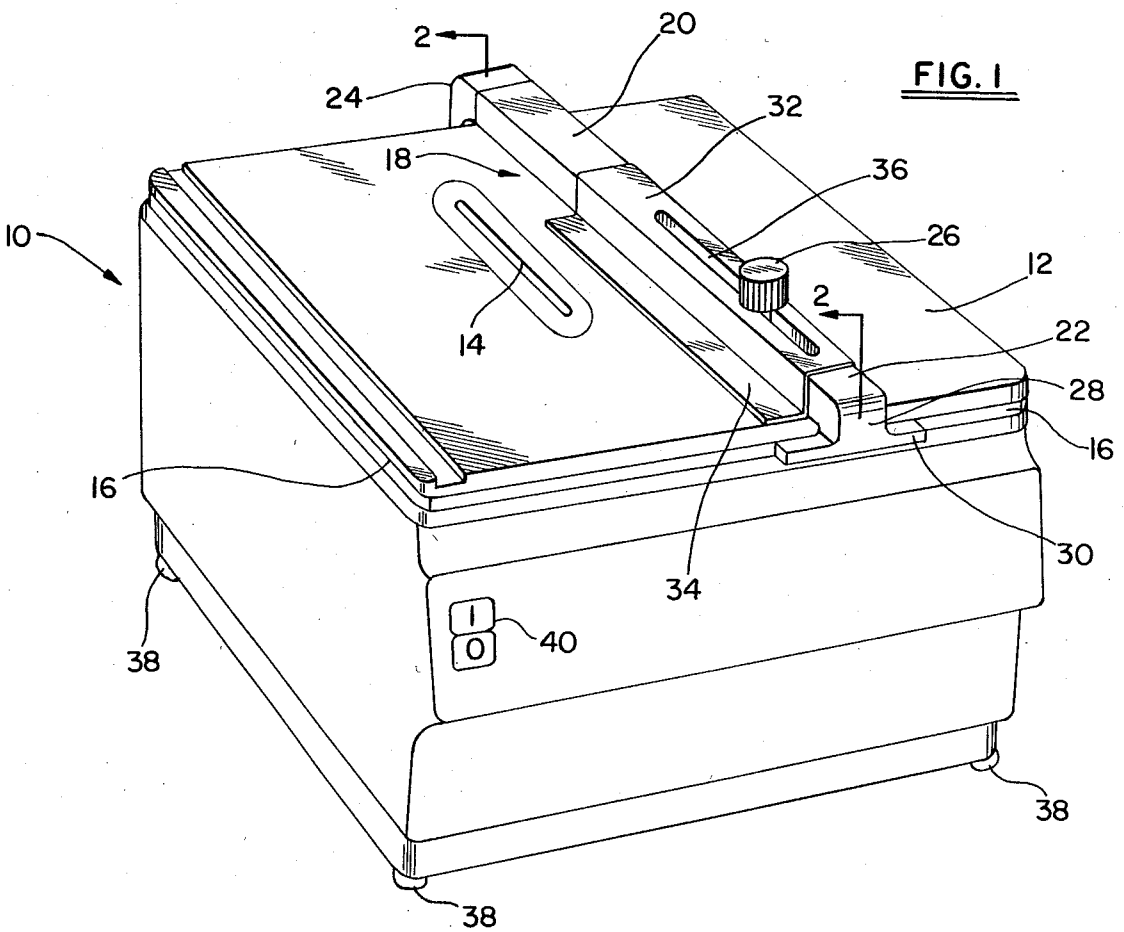
FIG. 1 shows diagrammatically a perspective view of a saw table equipped with an adjustable fence according to the invention.

The preferred embodiment of the adjustable fence of the present invention is shown in FIGS. 1 to 6, and a saw table equipped according to the invention with this adjustable fence is shown in FIG. 1.

FIG. 1 shows the saw table 10, illustrated in simplified form, having a table surface 12 in which a slit 14 is provided for the passage of a conventional circular saw blade (not shown). In the edge region underneath the table surface 12 there is a continuous groove 16 serving as a guide device for the adjustable fence 18. This continuous groove 16 is made up of a groove along each of the four sides of the saw table, and the fence 18 is mounted in the grooves in two opposite sides, as shown the front and the back of the saw table.

The fence 18 consists essentially of a tubular main fence member 20 and a separate auxiliary fence member 22. Fastened immovably in one end of the main fence member 20 is a clamping portion 24 rigidly retained in the main fence member 20, for example by means of gluing. The lower part of the clamping portion 24 engages in the portion of the groove 16 not shown in FIG. 1 and located on the rear side of the saw table 10.

The auxiliary fence member 22 is inserted into the other end of the hollow main fence member 20 and is pivotally fastened therein. A knurled headed screw 26 adjustably pivots the auxiliary fence member 22 relative to the main fence member 20 to clamp the fence 18 to, or release it from, the saw table 10, as will be described more fully later. The auxiliary fence member 22 has integral therewith a clamping portion 28, which is similarly shaped to the clamping portion 24, and comprises a hooked portion extending downwardly and which terminates in a foot portion 30. The foot portion 30 extends at right angles to the longitudinal direction of the main fence member 20 and engages in the portion of the groove 16 in the front wall of the saw table 10.

An extension fence 32 in the form of an inverted channel of U-section and having a flange 34 extending from one side thereof, is engaged over the main fence member 20 and slidable longitudinal therealong. The extension fence 32 has a slot 36 along the top thereof and through which engages the screw 26 by which the extension fence 32 is clamped in position on the main fence member 20. The length of the slot 36 determines the extent to which the extension fence 32 can be adjusted in either direction along the fence 18 as will be described more fully later.

The saw table 10 is provided with pads 38 at its lower four corners and on which it can be supported on a workbench. Switches 40 are provided in the front of the saw table for switching on and off and controlling an electric motor (not shown) housed in the saw table for driving the saw blade when present.

Figure 2:
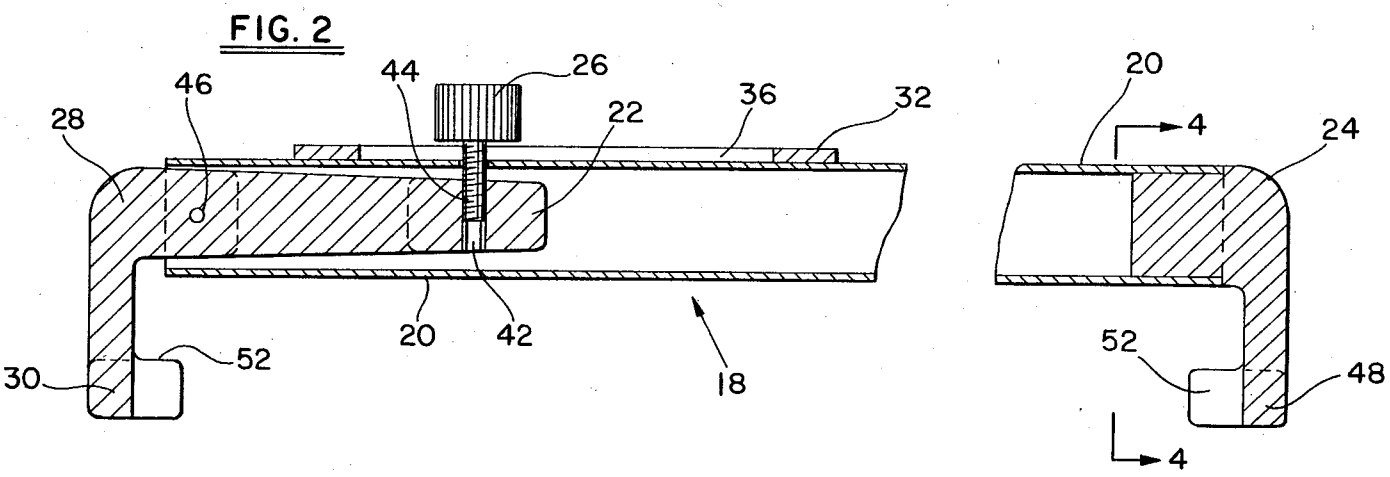
FIG. 2 is a longitudinal section through the adjustable fence on the line 2—2 of FIG. 1.
Figure 3:
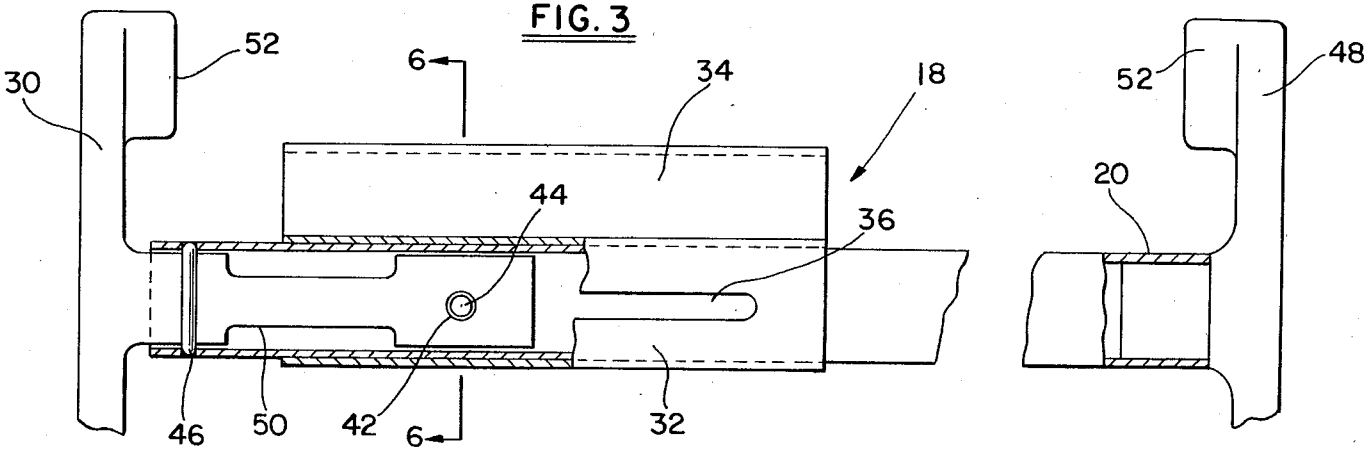
FIG. 3 is a plan view of the adjustable fence of FIG. 2, partly broken away and sectioned to show the interior thereof.
Figure 4:
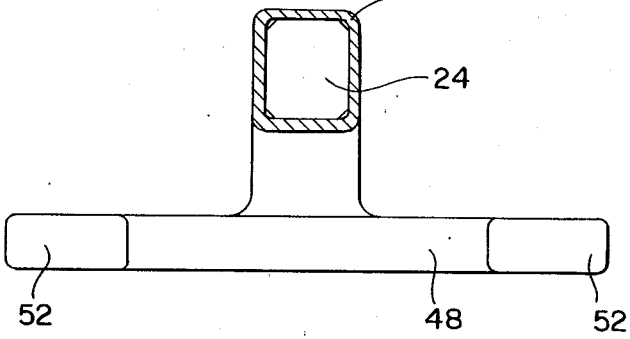
FIG. 4 is a section on the line 4—4 of FIG. 2 showing the clamping portion of the main fence member.

Referring now mainly to FIGS. 2 and 3, the auxiliary fence member 22 can be seen extending inside the hollow tubular main fence member 20 and having a vertical screw threaded bore 42 adjacent its inner end, the screw threaded bore 42 being threadedly engaged by the threaded shank 44 of the screw 26. Towards the outer end of the auxiliary fence member 22 adjacent the hooked portion thereof and adjacent the open end of the main fence member 22 (i.e. the left end in FIGS. 2 and 3), a pivot pin in the form of a peg or spindle extends horizontally through the auxiliary fence member 22. The ends of the pivot pin 46 are secured in and terminate in opposite side walls of the tubular main fence member 20. The dimensions of the auxiliary fence member 22 are selected so that it can be pivoted to and fro about the pivot pin 46 to such an extent that the distance between the foot portion 30 of the auxiliary fence member 22 and the corresponding foot portion 48 of the main fence member 20 varies sufficiently to effect clamping and release from clamping of the foot portions 30 and 48 in their respective opposite portions of the groove 16. Between the pivot pin 46 and the screw threaded bore 42, the auxiliary fence member 22 is waisted at 50. As can be seen from FIG. 2, both foot portions 30 and 48 extend downwardly below the main fence member 20 approximately the same distance. As can be seen more clearly from FIG. 3, the two foot portions 30, 48 also extend parallel to each other in a direction at right angles to the longitudinal direction of the fence 18. Each end of the transversely extending foot portions 30, 48 is formed with an inwardly extending foot 52 which slidably engages in the groove 16. The pair of feet 52 on each foot portion 30, 48 are spaced apart as shown in FIG. 4. FIG. 3 shows the inverted channel sectioned extension fence 32 fitting over the main fence member 20 with the flange 34 extending to one side. FIG. 2 shows the screw threaded stem 44 extending through the longitudinal slot 36 in the top of the extension slide 32, the head of the screw 26 firmly engaging the top of the extension fence 32 when screwed downwards to pivot the auxiliary fence member 22 counterclockwise in FIG. 2 to effect clamping between the clamping foot portions 30 and 48.

Figure 5:
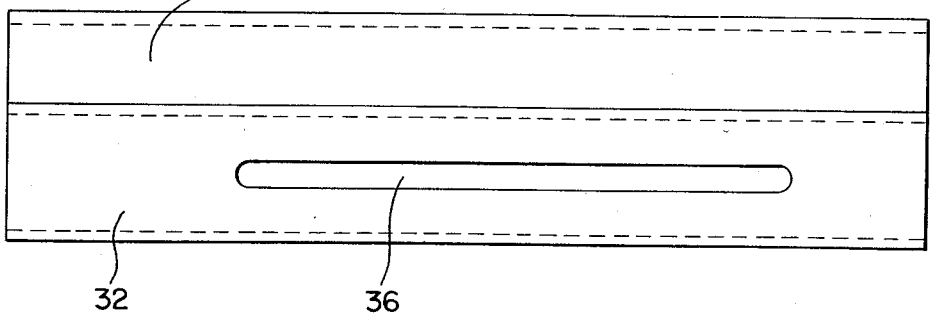
FIG. 5 is a plan view of the extension fence shown in FIG. 1.

FIG. 5 shows a full plan view of the extension slide 32 and showing the portion thereof broken away in FIG. 2.

Figure 6:
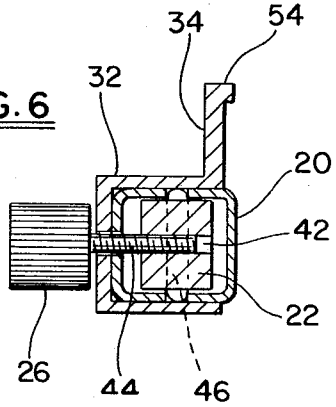
FIG. 6 is a section on the line 6—6 of FIG. 3 showing the engagement of the extension fence over the main fence member.

FIG. 6 is a section on the line 6-6 of FIG. 3 and shows the pivot pin 46 in broken lines to more clearly illustrate the right angle relationship between the pivot pin 46 and the screw shank 44. The engagement of the extension fence 32 around the main fence member 20 can be clearly seen, as can a short wall portion 54 of the extension 32 extending downwardly from the outer end of the flange 34 and at right angles thereto. This wall portion 54 forms a low bearing surface which is advantageously used when sheet-like or board-like material of small thickness is being sawn. The extension fence 32 can be arranged, as required, on the main fence member 20, in such a way that the flange 34 is located either on the side nearest the saw blade (as shown in FIG. 1) or on the side away from the saw blade, depending on how the fence 18 is being used. Preferably, the flange 34 faces the saw blade, and by appropriately positioning the extension fence 32 lengthwise relative to the saw blade, it is possible to prevent parts severed from the workpieces during cutting operations from being jammed between the saw blade and the fence 18.

In use, the screw 26 is unscrewed sufficiently to release the clamping effect of the clamping foot portions 30,48, this also rendering the extension slide 32 free to slide along the main fence member 20. The fence 28 is then moved laterally in FIG. 1 with the feet 52 sliding in opposite sections of the groove 16. When the fence 18 has been located in the desired lateral position, then the extension fence 34 is slid along the main fence member 20, and possibly over the extending portion of the auxiliary fence member 24, until located in the desired longitudinal position. Thereafter, the head of the screw 26 is turned to screw the shank 44 into the inner end of the auxiliary fence member 22 to shorten the distance between the foot portions 30 and 48, until the feet 52 clamp firmly in the respective opposite portions of the groove 16 to firmly locate the fence 18 in position. At the same time, the head of the screw 26 is caused to engage and clamp the top of the extension slide 32 against the top of the main fence member 20, so also locking the extension fence 32 in position. To reset either the lateral position of the fence 18 or the longitudinal position of the extension fence 32, the screw 26 is loosened and the above procedure repeated.

It will be appreciated that the present invention provides an adjustable fence which can readily be clamped at both ends to the saw table simply by tightening a single screw with one hand. Further, any desired position of the extension fence can also be fixed simultaneously by the tightening of this single screw.

It will also be appreciated that because of the slot 36, the extension fence can be displaced beyond the dimensions of the saw table, in order thereby to form an extended fence for longer workpieces.

The above described embodiment, of course, is not to be construed as limiting the breadth of the present invention. Modifications, and other alternative constructions, will be apparent which are within the spirit and scope of the invention as defined in the appended claims.

What is claimed is:

1. An adjustable fence for a saw table or the like, comprising:

an elongate main fence member defining a longitudinal direction and having a first clamping portion at one end;

an auxiliary fence member pivoted to said main fence member about a pivotal axis at right angles to said longitudinal direction, said auxiliary fence member extending from another end of said main fence member and having a a second clamping portion spaced from said first clamping portion in said longitudinal direction;

means, connected between said main and auxiliary fence members and actuatable by one hand of an operator, for adjustably pivoting said auxiliary fence member relative to said main fence member to shorten the distance between said first and second clamping portions, whereby said first and second clamping portions can be clamped against opposite sides of said table with said main fence member extending over the surface of said table;

said means comprising a screw;

said screw being threadedly engaged in said auxiliary fence member and having a head which bears against said main fence member; and said screw being at right angles to said pivotal axis and located between said pivotal axis and said one end of said main fence member.

2. The adjustable fence of claim 1, wherein said pivotal axis is at said other end of said main fence member.

3. The adjustable fence of claim 2, wherein said main fence member is hollow and said auxiliary fence member extends inside said main fence member.

4. The adjustable fence of claim 3, wherein said main fence member is tubular and said pivotal axis is defined by a pivot pin passing through said auxiliary fence member with the ends of the pivot pin being supported in opposite walls of said tubular main fence member, said pivot pin being parallel to the surface of said table.

5. The adjustable fence of claim 1, wherein said said first and second clamping portions extend downwardly from said longitudinal direction and terminate in foot portions directed towards each other and which are engageable in grooves along opposite sides of said table.

6. The adjustable fence of claim 5, wherein each of said foot portions comprises two feet spaced apart in a direction parallel to said pivotal axis.

7. The adjustable fence of claim 1, further comprising an extension fence slidably mounted on said main fence member and displaceable thereon in said longitudinal direction, the position of said extension fence relative to said main fence member being adjustably secured by said adjustably pivoting means.

8. An adjustable fence for a saw table or the like, comprising:

an elongate main fence member defining a longitudinal direction and having a first clamping portion at one end;

an auxiliary fence member pivoted to said main fence member about a pivotal axis at right angles to said longitudinal direction, said auxiliary fence member extending from an opposite end of said main fence member and having a second clamping portion spaced from said first clamping portion in said longitudinal direction;

means, connected between said main and auxiliary fence members and actuatable by one hand of an operator, for adjustably pivoting said auxiliary fence member relative to said main fence member to shorten the distance between said first and second clamping portions, whereby said first and second clamping portions can be clamped against opposite sides of said table with said main fence member extending over the surface of said table;

an extension fence slidably mounted on said main fence member and displaceable thereon in said longitudinal direction, the position of said extension fence relative to said main fence member being adjustably secured by said adjustably pivoting means; and said extension fence comprising a flanged channel member engaged over the top of said main fence member and having a slot extending in said longitudinal direction and through which said adjustably pivoting means engages.

9. An adjustable fence for a saw table, comprising:

an elongate hollow main fence member defining a longitudinal direction and having a clamping portion at one end;

an auxiliary fence member having another clamping portion and extending inside an opposite end of said main fence member;

a pivot pin mounted in said main fence member adjacent said opposite end thereof and pivotally supporting said auxiliary fence member;

said two clamping portions extending transversely from said longitudinal direction and having foot portions which are directed towards each other;

a screw passing into said main fence member and threadedly engaging a screw-threaded bore in said auxiliary fence member, said screw having a head which is manually turned by an operator to cause said auxiliary fence member to pivot about said pivot pin relative to said main fence member to shorten the distance between said foot portions for clamping the latter against opposite sides of the saw table;

said pivot pin being disposed at right angles to said screw and to said longitudinal direction; and said clamping portion of said auxiliary fence member and said screw being located on opposite sides of said pivot pin.

10. The adjustable fence of claim 9, further comprising an elongate extension fence engaged over and adjustably slidable along said main fence member, said extension fence having a longitudinal slot therein through which said screw engages to clamp said extension fence against said main fence member simultaneously with the clamping of said foot portions against the saw table.

11. The adjustable fence of claim 10, wherein said extension fence comprises a channel having a flange extending laterally from and along one side thereof, the free edge of the flange terminating in a short wall at right angles to the flange.

12. A saw table, comprising:

a table surface having a slot therein to accommodate a circular saw blade;

side walls extending downwardly from said table surface, said side walls having grooves therein adjacent said table surface;

an adjustable fence, for guiding a workpiece, extending across said table surface and having a downwardly extending clamping portion at each end, each clamping portion having an inturned foot portion slidably engaging in a respective one of said grooves;

said adjustable fence comprising an auxiliary fence member extending inside an open end of a hollow main fence member and being pivotally attached to the latter at a location adjacent said open end;

a manually operable adjusting screw operative between said main and auxiliary fence members for pivoting said auxiliary fence member relative to said main fence member to effect clamping of said foot portions in said grooves; and said screw being positioned part way along said main fence member and part way across said table surface with said location being disposed between said screw and said open end.

13. The saw table of claim 2, wherein each said foot portion comprises two spaced apart feet engaging in the respective groove.

14. The saw table of claim 13, wherein said main fence member is of tubular form and extends from one side of said table surface to the opposite side.

15. The saw table of claim 14, further comprising an elongate extension fence engaged over and adjustably slidable along said main fence member, said extension fence having a longitudinal slot therein through which said screw engages the clamp said extension fence against said main fence member.

16. An adjustable fence for a saw table, comprising:

an elongate hollow main fence member having a straight fence portion extending longitudinally between two ends thereof, one end being open and the other end having a first clamping portion connected thereto and extending downwardly therefrom;

an auxiliary fence member comprising a second clamping portion with an elongate portion extending therefrom through said open end inside and part way along said straight fence portion;

said second clamping member extending downwardly from said elongate portion and being spaced from said first clamping portion;

a pivot pin mounted in said straight fence portion adjacent said open end;

said auxiliary fence member being mounted on said pivot pin for limited pivoting of said elongate portion inside said straight fence portion;

an adjusting screw passing downwardly into said straight fence portion and threadedly engaging a transversely extending screw-threaded bore in said elongate portion of said auxiliary fence member;

said screw being spaced from said open end at a location part way along said straight fence portion;

said pivot pin being positioned between said screw and said open end; and said screw having a head which is manually rotatable by an operator to cause said auxiliary fence member to pivot about said pivot pin relative to said main fence member to shorten the distance between said first and second clamping portions for clamping said clamping portions against opposite sides of the saw table.

17. The adjustable fence of claim 16, wherein:

said pivot pin is closer to said open end than to said screw;

said screw extends vertically downwards through a hole in a top wall of said straight fence portion;

said elongate portion moves towards said top wall when said head is rotated to shorten the distance between said clamping portions;

said clamping portions have upright central portions with transversely extending foot portions; and each foot portion has integrally formed therewith a pair of spaced apart feet, said feet being directed inwardly below said main fence member for engaging in grooves in said opposite sides of said saw table.

18. The adjustable fence of claim 16, wherein said screw extends downwards through a hole in a top wall of said main fence member; and further comprising:

an elongate channel member engaged over and extending along said top wall of said main fence member and having a longitudinal slot;

a flange extending laterally from and along one side of said channel member;

a free edge of said flange terminating in a short wall at right angles to said flange;

said screw engaging through said slot;

said channel member being adjustably slidable along said main fence member to form a longitudinal extension of said adjustable fence; and said channel member being clamped, in an adjusted position, between said top wall and said head when said head is rotated to clamp said clamping portions against the saw table.

* * * * *